United States Patent [19]

Johnson

[11] 4,203,575

[45] May 20, 1980

[54] HYDRAULIC ELEVATING RAMP

[75] Inventor: Earl R. Johnson, Tulsa, Okla.

[73] Assignee: Loffland Brothers Company, Tulsa, Okla.

[21] Appl. No.: 20,917

[22] Filed: Mar. 15, 1979

[51] Int. Cl.[2] ..... E02C 3/00

[52] U.S. Cl. ..... 254/88

[58] Field of Search ..... 254/88, 90; 105/368 R; 14/69.5, 71.1, 71.3, 72.5

[56] References Cited

U.S. PATENT DOCUMENTS

| | | | |
|---|---|---|---|
| 3,074,241 | 1/1963 | Cahill et al. | 14/71.1 |
| 3,881,207 | 5/1975 | Jones et al. | 14/69.5 |

FOREIGN PATENT DOCUMENTS

| | | | |
|---|---|---|---|
| 666230 | 7/1963 | Canada | 254/88 |
| 52395 | 12/1966 | German Democratic Rep. | 14/71.1 |

*Primary Examiner*—Robert C. Watson
*Attorney, Agent, or Firm*—Head & Johnson

[57] ABSTRACT

An elevating ramp for vehicles comprising a first ramp section disposed at a preselected angle with respect to the horizontal whereby the vehicle may ascend the said ramp section until the entire vehicle is disposed thereon, and a second ramp section connected with the first ramp section for receiving the vehicle thereon, said second ramp section being disposed at a greater angle with respect to the horizontal than the first ramp section whereby the vehicle may be moved through a total angular dimension with respect to the horizontal which is greater than the physical characteristics of the vehicle normally permit. When the vehicle has been positioned on the apparatus, the position of the ramp may be hydraulic adjusted for supporting the entire vehicle in a substantially horizontal position elevated above the surface of the ground.

5 Claims, 9 Drawing Figures

HYDRAULIC ELEVATING RAMP

BACKGROUND OF THE INVENTION

1. Field of the Invention

This invention relates to improvements in ramps for elevating vehicles to positions above the surface of the ground, and more particularly, but not by way of limitation, to a ramp having more than one angular ramp portion whereby the vehicle may be driven along the ramp at a total angle greater than that permitted by the structural characteristics of the vehicle.

2. Description of the Prior Art

It is common practice today to mount relatively small or portable drilling rigs on vehicles whereby the drilling rig may be transported to the site of a well bore and erected for a well drilling operation, or the like. Subsequent to the well drilling operation, these drilling rigs may be removed from the well site, and transported to another location by the vehicle in order that the drilling rig may be used for drilling additional well bores. The vehicles normally comprise large off-highway type structures of a relatively long overall length for carrying the drilling rig in a horizontal position during transporting thereof from site to site. It is the usual practice to provide two sets of running wheels for these vehicles, with one set of wheels being disposed in the proximity of the rear of the vehicle. At the well bore site, the vehicle is positioned in such a manner that the drilling rig may be hoisted to a vertical or upright position, with the location of the rig being at an optimum for normal use during the well drilling operation. Of course, most of the weight of the erect drilling rig is supported by the forward or leading wheels of the vehicle. In addition, the remaining portions of the vehicle bed support the draw works and other equipment necessary for the well drilling operation, as is well known.

In the light of current concern about the ecology, and environment, and the like, it has become necessary to utilize a considerable amount of additional equipment at the surface of a well bore, such as blow out preventers, and the like. As a result it is necessary to position the drilling rig in such a manner that the elevation thereof, and particularly the elevation of the drilling platform provided thereon, be sufficient for providing clearance for these blow out preventers, and the like. Since the overall length and general construction of the vehicle upon which the drilling rig is mounted permits the vehicle to travel along a ramp having an angle no greater than seven degrees from the horizontal, the problem of positioning the drilling rig at greater elevations is difficult. In some instances, the usual hydraulically actuated stilts or jacks utilized for stabilization of the rigs have been installed or supported at the bottom by channel beams, base structers, or the like, but these have not been entirely satisfactory in that the weights and normal working conditions during the drilling of a well bore are often too great for this type supporting arrangement.

SUMMARY OF THE INVENTION

The present invention contemplates a novel ramp device adapted for receiving the vehicle therealong in order to elevate the position of the entire vehicle sufficiently for positioning the drilling rig at the desired elevation above the well site. Since the normal elevation required for the installation of the drilling rig is usually greater than the seven degree angle along which the vehicle can move, the novel ramp is particularly designed with at least two different or separate ramp portions in order to "fool" the vehicle into "thinking" it is travelling only along a seven degree rise. One end, as for example the forward end of the apparatus is provided with a framework structure disposed at the proper height for supporting the vehicle and drilling rig at the required height during the drilling operation. The opposite end, or rear end of the apparatus is initially disposed in contact with the surface of the ground in order that the vehicle may engage the apparatus and travel upwardly along the ramp toward the forward end thereof. A first ramp portion is provided at the rear of the apparatus and is inclined upwardly at substantially seven degrees with respect to the horizontal, and is sufficiently long for receiving both the forward and rearward running gears or wheels of the vehicle thereon. As soon as the vehicle has moved through a sufficient distance for disposition of the entire vehicle on the first ramp portion, the forward or front wheels of the vehicle begin to travel along a second ramp portion. The second ramp portion is conterminous with the first ramp portion and is disposed at a greater angle with respect to the horizontal than the first ramp portion, preferably at approximately seven degrees greater. The vehicle continues to move along the second ramp portion, and when the forward running gear or wheels reach or approach the forward end of the second ramp portion, the rear portion of the ramp apparatus may be elevated by suitable hydraulic cylinder means, or the like, for raising the vehicle to a substantially horizontal position, whereupon the vehicle may be driven forward through the necessary distance for positioning the forward running gear on the forward frame of the apparatus. Thus, the vehicle may be driven through a total of fourteen degrees inclination from the horizontal, and may be supported in the horizontal position during the erection of the drilling rig and throughout the entire well drilling operation, as is well known. Of course, it is to be noted that more than two ramp portions may be provided on the apparatus if additional height is required for the final position of the vehicle in the rig supporting position. At the end of the drilling operation, and when it is desirable to lower the drilling rig and transport the entire drilling apparatus to another site, the operation of the ramp apparatus may be reversed.

DESCRIPTION OF THE PREFERRED EMBODIMENT

Figure 2:
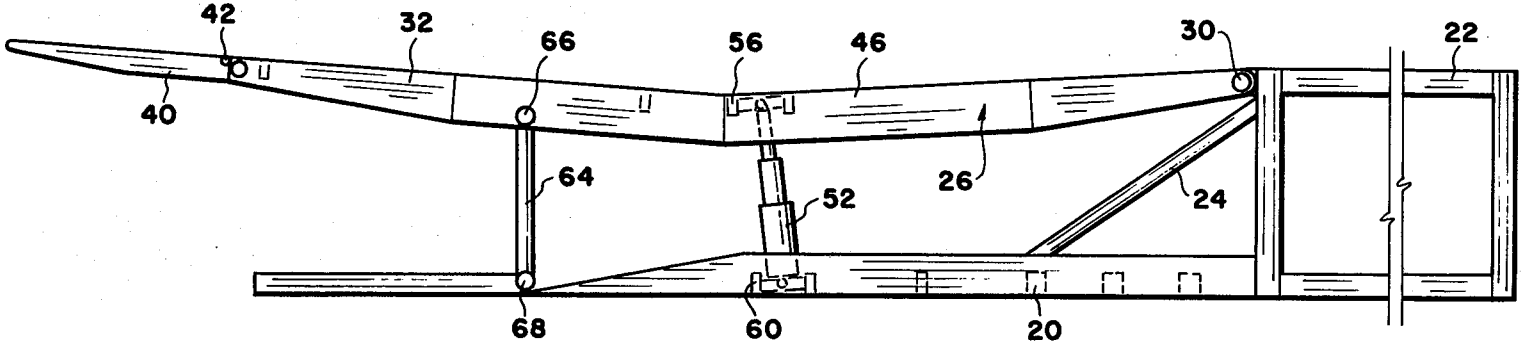
FIG. 2 is a side elevational view of a ramp apparatus embodying the invention and depicted in the elevated position thereof.

Referring to the drawings in detail, reference character 10 generally indicates a ramp apparatus comprising a substantially box-like framework 12 at one end thereof and having a pair of substantially mutually parallel I-beam members 14 and 16, or the like, extending outwardly from the lower portion thereof and adapted to rest on the surface 18 of the ground. A plurality of longitudinally spaced transversely extending cross members 20 are welded or otherwise secured between the I-beams 14 and 16 for rigidity and to maintain the spaced relationship therebetween. The framework 12 may be of any suitable construction as is well known, and includes an upper support base 22 disposed in a substantially horizontally oriented plane for a purpose as will be hereinafter set forth. In addition, it is preferable to provide a pair of angularly disposed brace member 24 (only one of which is shown in the drawings) welded or otherwise secured between the I-beams 14 and 16 and the framework 12 for strengthening of the structure 10, as is well known.

Figure 1:
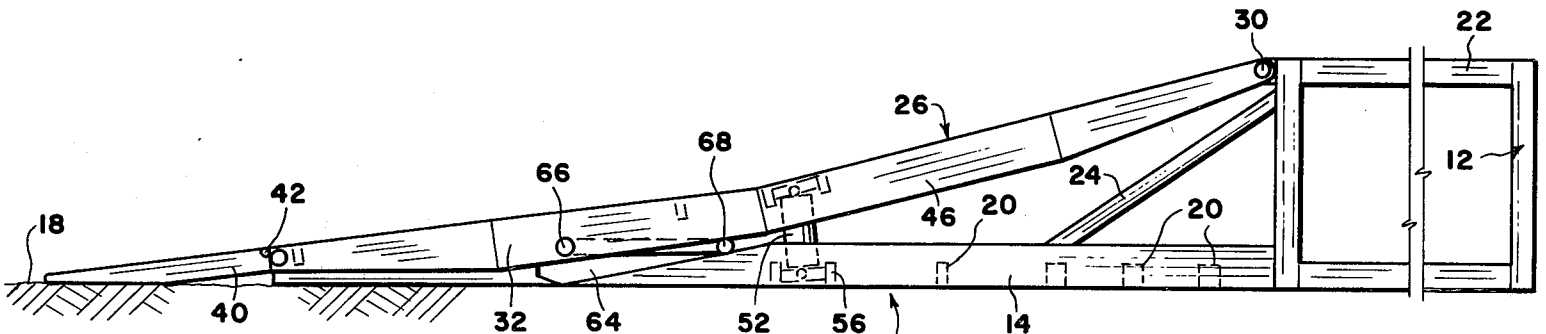
FIG. 1 is a side elevational view of a ramp apparatus embodying the invention and depicted in the lowered position thereof.
Figure 3:
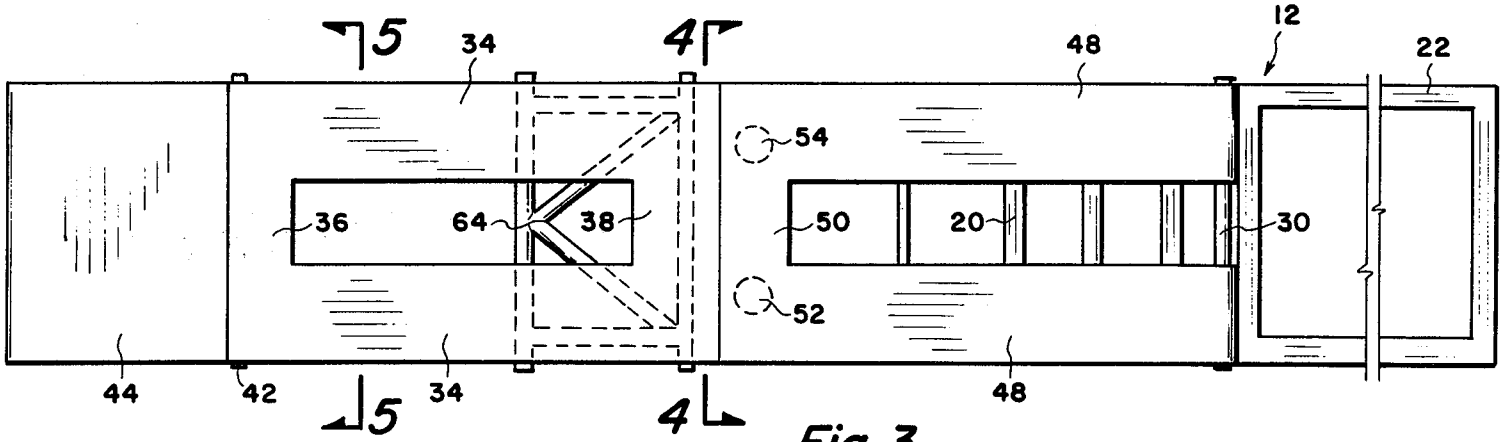
FIG. 3 is a plan view of a ramp apparatus embodying the invention, with portions depicted in broken lines for purposes of illustration.
Figure 5:
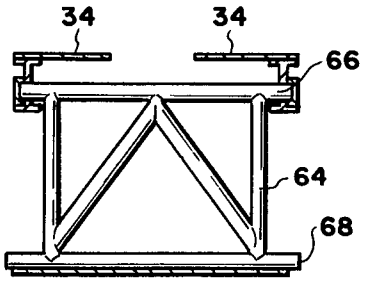
FIG. 5 is a view taken on line 5—5 of FIG. 3.
Figure 4:
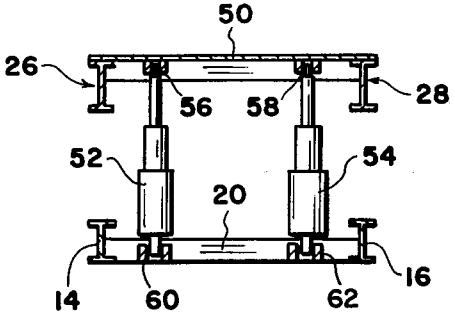
FIG. 4 is a view taken on line 4—4 of FIG. 3.

A pair of substantially identical I-beam assemblies 26 and 28 are spaced above the I-beams 14 and 16 in substantial vertical alignment therewith as particularly shown in FIG. 4. The inner end of each I-beam assembly 26 and 28 is welded or otherwise secured to a pivot shaft 30 which in turn is secured to the upper forward edge of the framework 12 in any suitable manner for rotation about its own longitudinal axis. In this manner, the beam assemblies 26 and 28 may pivot simultaneiously about the axis of the shaft 30 for a purpose and in a manner as will be hereinafter set forth. The I-beam assemblies 26 and 28 each comprise a first section 32 having a plate member 34 welded to the upper edge thereof as particularly shown in FIGS. 3 and 5 to provide a driving ramp. The bottom edge of the I-beam assemblies 26 and 28 is preferably substantially V-shaped in configuration whereby the plane of the plate 34 will be disposed at an angle of substantially 7° with respect to the surface 18 of the ground in the lowered position of the assemblies 26 and 28 as shown in FIG. 1. In addition, the opposite ends of the spaced plates 34 are connected by plates or cross members 36 and 28 (FIG. 3) for rigidity and strength.

Figure 6:
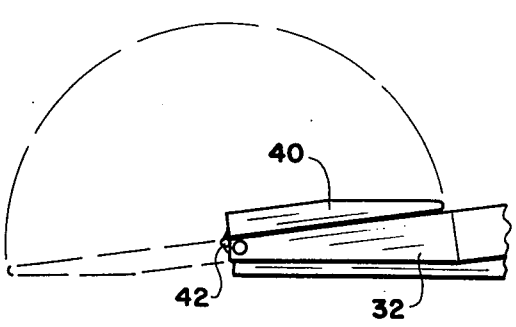
FIG. 6 is a broken elevational view of one end of a ramp apparatus embodying the invention and illustrating one position thereof in solid lines.

A second section 40 is pivotally secured to the forward or outer end of each section 32 in any suitable manner, such as by transversely extending shaft 42 secured to the forward end of the plates 34 and 36. The shaft 42 is secured to the leading or forward end of the sections 32 and is suitably journalled therebetween for rotation about its own longitudinal axis whereby the sections 40 may be pivoted to a position adjacent the surface 18 in one position for the apparatus 10, and in a position adjacent the upper surface of the plates 3436 in a storage position, as shown in FIG. 6. A plate member 44 (FIG. 3) is welded or otherwise secured to the upper edges of each section 40 and spans the distance therebetween for alignment with the plates 34 and 36 in the lowered position of the sections 40, as shown in FIG. 1. Of course, the lower edge of each section 40 is preferably of a substantially V-shaped configuration whereby the planar angle of the plate 40 will be substantially 7° with respect to the surface 18 of the ground for providing a continuation of the plates 34 and 36.

A third section 46 is rigidly secured to the rearward or opposite end of each section 32 and is generally similar to the section 32 in that a longitudinally extending plate 48 is welded, or the like, to the upper edges thereof, and at least one end of the spaced plates 48 are connected together by a transversely extending plate 50 as shown in FIG. 3. The sections 46 are secured to the sections 32 in such a manner that the planar angle of the plates 48 and 50 is substantially 7° with respect to the plane of the plates 35, 36 and 38, as will be particularly seen in FIGS. 1 and 7 through 9. A pair of spaced cylinders 52 and 54 of any suitable type, such as hydraulic, pneumatic, or the like, have one end thereof operably connected with the underside of the plates 48–50 as shown at 56 and 58, respectively, in FIG. 4. The opposite ends of the cylinders 52 and 54 are suitably anchored to the ground, or to a suitable cross member, as shown at 60 and 62 in FIG. 4. The cylinders 52 and 54 are operable in the usual manner between extended and contracted positions therefor in order to selectively pivot the I-beam assemblies 26 and 28 about the pivot shaft 30 for a purpose as will be hereinafter set forth. In addition, a support frame 64 is interposed between the I-beams 14 and 16 and the associated assemblies 26 and 28, and is preferably disposed outboard of the cylinder 52 and 54. One edge of the frame is pivotally secured to the assemblies 26 and 28 by a suitable pivot shaft 66, and the opposite edge of the frame 64 is similarly pivotally secured to the I-beams 14 and 16 by a pivot shaft 68 whereby the frame 64 will be disposed in a substantially upright, locked supporting position when the assemblies 26 and 28 are in a raised position, as shown in FIG. 2, and in a lowered, out of the way position when the assemblies 26 and 28 are in a lowered position, as shown in FIG. 1.

Figure 7:
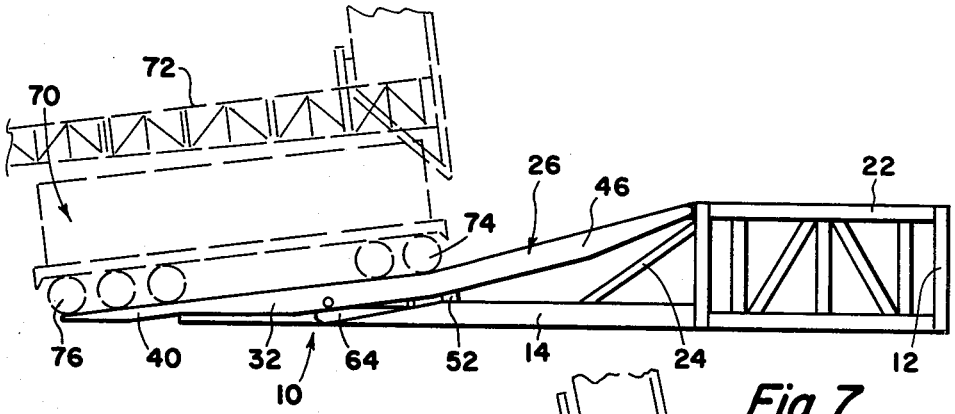
FIG. 7 is a side elevational view of a ramp apparatus embodying the invention with a vehicle depicted in an initial position thereon, and shown in broken lines for purposes of illustration.
Figure 8:
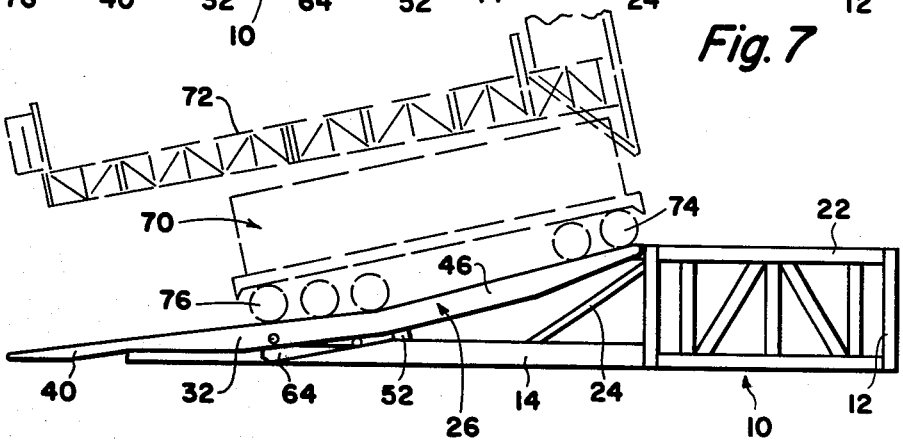
FIG. 8 is a view similar to FIG. 7 illustrating the vehicle in a more advanced position on the ramp apparatus.
Figure 9:
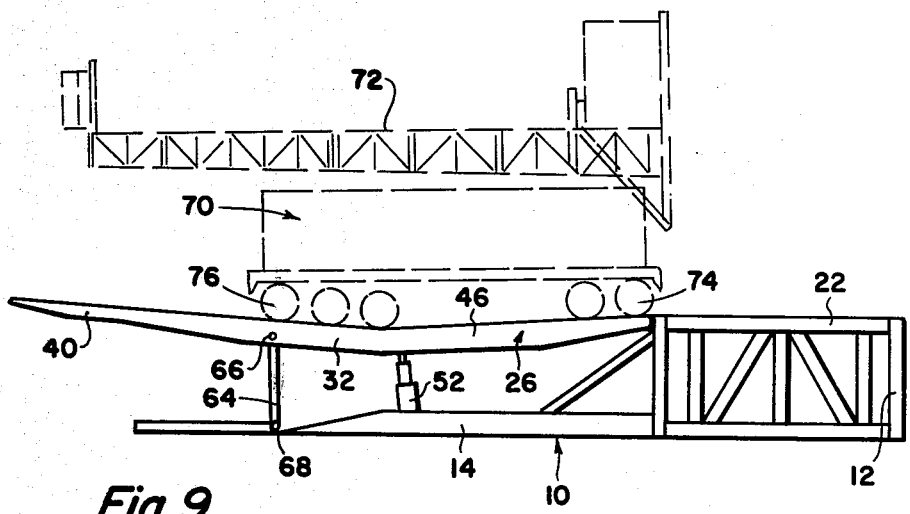
FIG. 9 is a view of a ramp apparatus embodying the invention and illustrated in an elevated position for supporting a vehicle in an elevated substantially horizontal position, with the vehicle depicted in broken lines for purposes of illustration.

Referring now to FIGS. 7, 8 and 9, when a vehicle or portable drilling rig 70, such as shown in broken lines, is to be utilized for a well bore drilling operation, or the like, the apparatus 10 is transported to the well drilling site in any well known manner and installed thereon with the framework 12 disposed at the position wherein the drilling mast or derrick 72 is to be erected to its normal upright operating position (not shown). The cylinders 52 and 54 are placed in the contracted position thereof, and the section 40 of the I-beam assemblies 26 and 28 is pivoted from the storage position shown in solid lines in FIG. 6 to the operational position thereof shown in broken lines. In this manner, the plate 44 becomes an extension of the plates 34 and 36 and cooperates therewith to provide an upwardly angled driving ramp positioned at substantially a 7° rise with respect to the surface 18 of the ground. As hereinbefore set forth, a 7° grade is the maximum angle at which a drilling rig 70 may be manuevered during a driving operation. The combined lengths of the section 40 and the sections 32 is at least as long as the overall length between the forward and rear wheels 74 and 76, respectively, of the drilling rig 70. Consequently, the entire rig 70 may be driven onto the ramp provided by the two sections 40 and 32, as clearly shown in FIG. 7.

When the entire rig 70 has thus been positioned on the sections 40 and 32, the continued forward driving of the vehicle will move the forward position of the rig 70 to the proximity of the forward end of the sections 46, as shown in FIG. 8. When the vehicle 70 has reached this position, the cylinders 52 and 54 may be actuated in the usual manner for providing an extended position therefor, thus pivoting the assemblies 26 and 28 about the pivot shaft 30. At the same time, the pivotal frame 64 will be pivoted to its upright position as shown in FIG. 9, and securely locked in this position for cooperating with the cylinders 52 and 54 to retain the assemblies 26 and 28, and the drilling rig 70 in the elevated position shown in FIG. 9. From this position of the vehicle 70, the rig may be driven forwardly through an additional distance sufficient for positioning the leading wheel assembly on the apparatus at the optimum position for erection of the derrick 72. The rig 70 may be braked or otherwise anchored in this operational position whereupon the device or mask 72 may be elevated to the usual upright position therefor, and the well drilling operation, or the like, may proceed in the usual manner.

Of course, when the drilling operation has been completed, or it is necessary to remove the drilling rig 70 from the operational position thereof for any reasons, the operation may be reversed in order that the vehicle 70 may be backed into a position on the surface of the ground.

From the foregoing it will be apparent that the present invention provides a novel elevating ramp for facilitating the positioning of a portable drilling rig for the drilling or a well bore, or the like. The novel ramp comprises a first ramp portion having an elevating angle of substantially 7° with respect to the horizontal, and of a length at least as long as the forward and rearward wheels of the vehicle whereby the entire vehicle may be moved to a position of support on the first ramp portion. A second ramp portion is connected with the first ramp portion and is disposed at an angle of substantially 7° with respect thereto whereby the vehicle is "fooled" into "thinking" that it is moving upwardly through only a 7° angle, but the actual overall effect is a 14° upwardly angular movement. Hydraulic cylinder, or the like, are operably connected with the ramp elements for elevating of the ramp and the drilling rig supported thereby whereby the ultimate operational of the drilling rig is substantially horizontal, and the well drilling operation may proceed in the normal or usual manner.

Whereas the present invention has been described in particular relation to the drawings attached hereto, it should be understood that other and further modification, apart from those shown or suggested herein may be made within the spirit and scope of this invention.

What is claimed is:

1. An elevating ramp for wheeled vehicles and comprising a support base structure having an elevated support element, a ramp assembly extending outwardly from said support base structure and pivotally connected therewith for alternate lowered and raised positions with respect to the surface of the ground, said ramp assembly comprising at least two successive end to end separate sections disposed at planar angles with respect to each other, the angular difference between the two sections being approximately 7° , a first of said sections being of a length at least as great as the wheel base of the vehicle and being disposed adjacent the surface of the ground in the lowered position of the ramp assembly for initially receiving the vehicle thereon and extending at an upward angle of approximately 7° between the surface of the ground and the beginning of the succeeding section, said succeeding section extending upwardly from the first section whereby the vehicle may be driven along the entire length of the ramp apparatus through a total angular elevation of 14° with respect to the surface of the ground while maintaining no driving angle for the vehicle in excess of approximately 7°.

2. An elevating ramp for vehicles as set forth in claim 1 and including contractable and expandable cylinder means operably connected with the ramp assembly for selective raising and lowering thereof with respect to the support base structure for altering the angular position therebetween for supporting of the vehicle on the ramp assembly in a substantially horizontally disposed position.

3. An elevating ramp for vehicles as set forth in claim 2 wherein the cylinder means comprises a pair of hydraulically actuated cylinders operably connected with the ramp assembly for pivoting thereof with respect to the support base structure.

4. An elevating ramp for vehicles as set forth in claim 2 and including pivotal support frame means operably connected with the ramp assembly and movable upon raising thereof for facilitating supporting of the ramp assembly in the raised position.

5. An elevating ramp for vehicles as set forth in claim 1 wherein the vehicle is a portable drilling rig having a portable derrick carried thereon, and said support base structure includes box-like framework means having said elevated support element substantially horizontally disposed whereby the derrick is supported by the elevated support element and the vehicle is supported by the ramp assembly in the elevated operation position of said ramp assembly.

* * * * *